United States Patent [19]

Goldhammer et al.

[11] Patent Number: 4,860,963

[45] Date of Patent: Aug. 29, 1989

[54] CUTTING MECHANISM FOR DEVICES FOR COMMINUTING MATERIAL

[75] Inventors: Albert Goldhammer, Ueberlingen; Hans Schleicher, Markdorf; Hartmut Stangenberg, Owingen; Rolf Gasteier, Markdorf, all of Fed. Rep. of Germany

[73] Assignee: Feinwerktechnik Schleicher & Co., Fed. Rep. of Germany

[21] Appl. No.: 163,625

[22] Filed: Mar. 3, 1988

[30] Foreign Application Priority Data

Mar. 4, 1987 [DE] Fed. Rep. of Germany ..... 3706855

[51] Int. Cl.[4] ..... B02C 4/08

[52] U.S. Cl. ..... 241/236; 241/295

[58] Field of Search ..... 241/236, 166, 235, 167, 241/293, 294, 295

[56] References Cited

U.S. PATENT DOCUMENTS 3,991,944 11/1976 Baikoff ..... 241/36

FOREIGN PATENT DOCUMENTS 18722 4/1914 Denmark ..... 241/236
285045 4/1913 Fed. Rep. of Germany .
2247901 7/1976 Fed. Rep. of Germany .
2514432 10/1976 Fed. Rep. of Germany ..... 241/236
3313103 10/1984 Fed. Rep. of Germany .
1507585 12/1967 France .
2435285 5/1980 France ..... 241/236
1392319 4/1975 United Kingdom .

*Primary Examiner*—Mark Rosenbaum
*Attorney, Agent, or Firm*—Steele, Gould & Fried

[57] ABSTRACT

A cutting tool for shredding machines has two cutting rollers meshing with cutting disks, which have "tooth on tooth" aligned, forwardly tilted, sloping sawteeth. At their tips, the teeth have notches, so that the tips are twice serrated. The slope of the teeth is such that when they engage in the material to be comminuted they face one another in substantially centrally loaded manner.

19 Claims, 3 Drawing Sheets

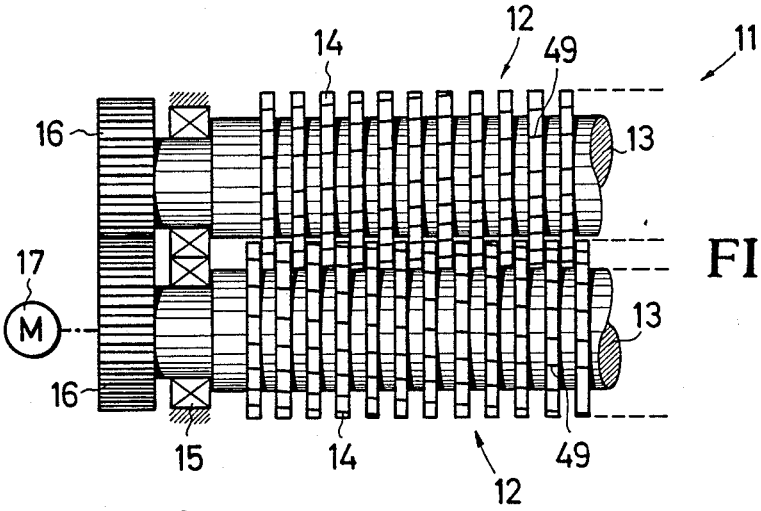
FIG. 3
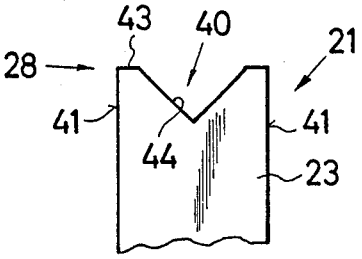
FIG. 4
FIG. 5
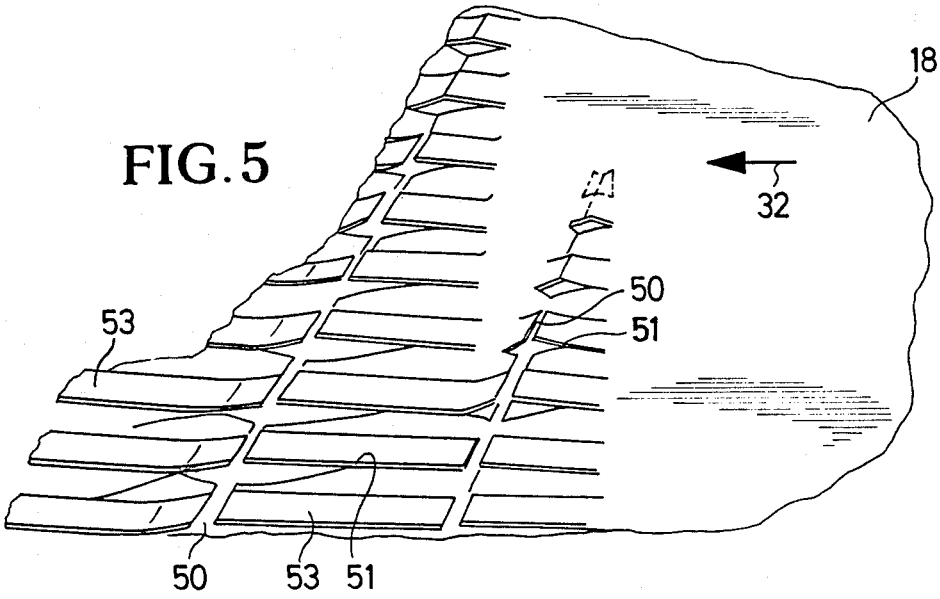

CUTTING MECHANISM FOR DEVICES FOR COMMINUTING MATERIAL

BACKGROUND OF THE INVENTION

1. Field of the Invention

The invention relates to a cutting mechanism for devices for comminuting or reducing the size of material and products, particularly flat material layers, such as documents, etc.

2. Prior Art

Conventional shredding machines have two cutting rollers with meshing cutting disks between which a longitudinal material cut takes place to product strips parting. A cut, in which the strips are reduced to individual particles, is brought about in that slots are provided in the upper surfaces of the cutting disks into which the material is forced by the adjacent disk and is consequently broken down. These shredding machines, e.g. according to German Pat. No. 22 47 901, in which the slots on adjacent disks are in each case reciprocally displaced by a half pitch or spacing, operate in a completely satisfactory manner, provided that the particles can be long enough for the slot to be made sufficiently large compared with the slot pitch and the layer thickness is not so large that the slot can become clogged. If such a shredding machine is overloaded by excessively thick layers, then the breaking down of the strips into individual particles may not take place completely, at least on one side of the layer.

German Pat. No. 33 13 103, which has star-like teeth on both cutting disks, and British Pat. No. 1,392,319, which has numerous narrow, high, curved sawteeth, reveal similar systems with a "tooth on gap" alignment.

For the purpose of comminuting individual document portions, German Pat. No. 285,045 discloses the use of cutting disks, in which circumferentially distributed tips symmetrical to a radius of the cutting disk function in "tooth on tooth" manner, whereby they initially pass transversely through the document and then cut through the same longitudinally. However, for this purpose the document must be kept taut or rigid by a feed roller pair. As a result of this complicated construction and the limitation to single layer documents, this proposal has not been practically adopted and has been virtually forgotten.

An object of the invention to provide a cutting mechanism making it possible to also cut thicker layers of documents into particles, particularly shorter particles.

This object is achieved by use of two cooperating cutting rollers driven in rotary synchronized manner in opposite rotation directions, the rollers having alternating, overlapping cutting disks, each cutting disk of one of the cutting rollers engaging in a ring slot between adjacent cutting disks of the other of the cutting rollers, outer edges of each cutting disk forming two cutting edges and having on an outer circumference of the disk teeth defining tooth tips extending from tooth roots, the tooth tips being aligned and the disks being synchronized as driven such that on adjacent cutting disks two corresponding teeth are approximately juxtaposed in a longitudinal direction of the cutting rollers in a tooth-on-tooth relationship, the teeth being inclined forward in sawtooth manner pointing in the rotation direction of the corresponding cutting roller, the adjacent cutting disks of the two cooperating cutting rollers being positioned such that the teeth of the adjacent cutting disks overlap one another radially at said tooth roots. As a result of the "tooth on tooth" arrangement for adjacent cutting disks with a corresponding inclination of the teeth, the flat material layer is penetrated from either side by the teeth in a position ensuring optimum penetration. The center lines of the teeth are approximately in one plane and during the penetration do not move the material being cut outwards against the feed direction.

Thus, the device does not require leading feed rollers. In addition, the loading direction of the teeth during pushing through is largely central, i.e. virtually ideal, although this does not initially appear to be the case with pronouncedly forwardly inclined teeth. A further advantage is that the forwardly inclined tooth shape aids the removal of particles from the slot, in that the front tooth profile acts there in the manner of a shovel, which raises the particles out of the slot and therefore relieves any following strippers.

Further advantages and features of the invention can be gathered from the subclaims and description in conjunction with the drawings and the individual features can be realized in embodiments of the invention and in other uses either singly, or in the form of subcombinations.

BRIEF DESCRIPTION OF THE DRAWINGS

An embodiment of the invention is described hereinafter relative to the drawings, wherein:

FIG. 3 is a part plan view of a cutting mechanism.

FIG. 4 is a detail view of a tooth of a cutting disk.

FIG. 5 is a perspective view of a first partly cut material for comminution (sectional view).

DETAILED DESCRIPTION OF THE PREFERRED EMBODIMENTS

Figure 1:
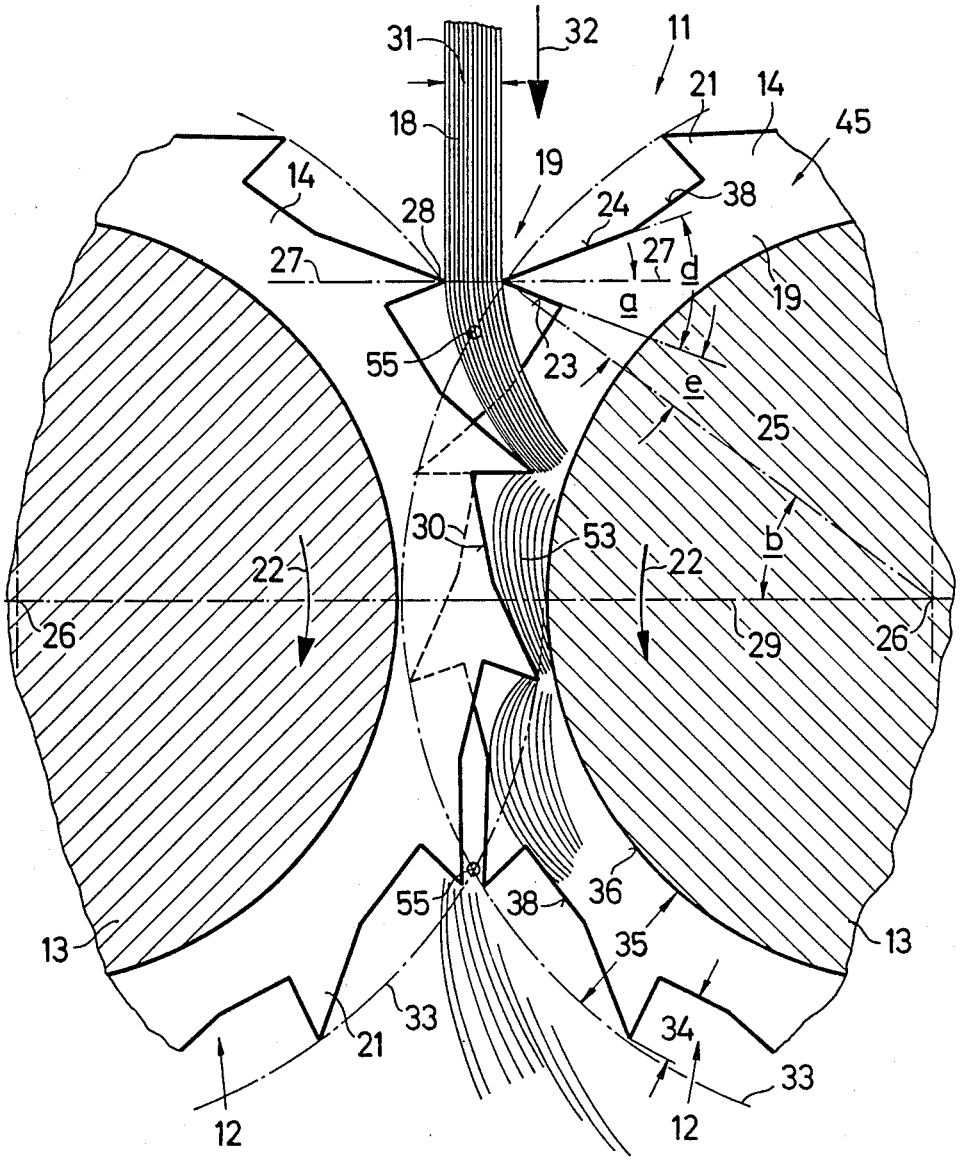
FIGS. 1 and 2 are detail sections through the cutting mechanism in two different working positions.

The represented cutting mechanism 11 has two cutting rollers 12, which in each case have a through cutting shaft 13 and cutting disk 14 projecting therefrom at regular intervals. The cutting disks can be constructed in one piece with the shaft 13 in the form of ring flanges, but can also be manufactured as individual ring disks, which are arranged in sequence on a shaft, whilst interposing spacers. The two cutting rollers 12 are mounted parallel to one another in bearings 15 and are driven by a diagrammatically indicated motor 17 by meshing gears 16 having the same speed, but which rotate in opposite directions. They are arranged in such a way that the cutting disks engage with one another and in each case alternately one cutting disk of one cutting roller engages in the gap between two other cutting disks 14. In order to produce cutting engagement between the cutting disks, the slots are in each case only wider by a tenth of a millimeter than the cutting disks engaging therein.

In the represented example, the material to be comminuted 18 of a relatively thick flat material layer of e.g. 50 sheets, which approximately corresponds to 5 mm, is introduced from above into the cutting gap between cutting rollers 12 and can drop freely thereinto, without any guide or feed rollers being required beforehand.

The cutting disks comprise a rotary ring part and teeth 21 projecting in outwardly sloping manner therefrom. For both cutting rollers, the teeth are forwardly inclined in the rotation direction, namely by the tilt angle a, which is defined as the angle between the plane 27 along the bisecting line of the tooth (shown in the drawing as line 27) between the front surface 23 and back surface 24 of the tooth with respect to the radius 25 between the tip and the particular cutting roller axis 26. The teeth have a triangular contour. In the case of a curved contour, plane 27 would have to be determined in accordance with the action conditions of the tooth.

Figure 2:
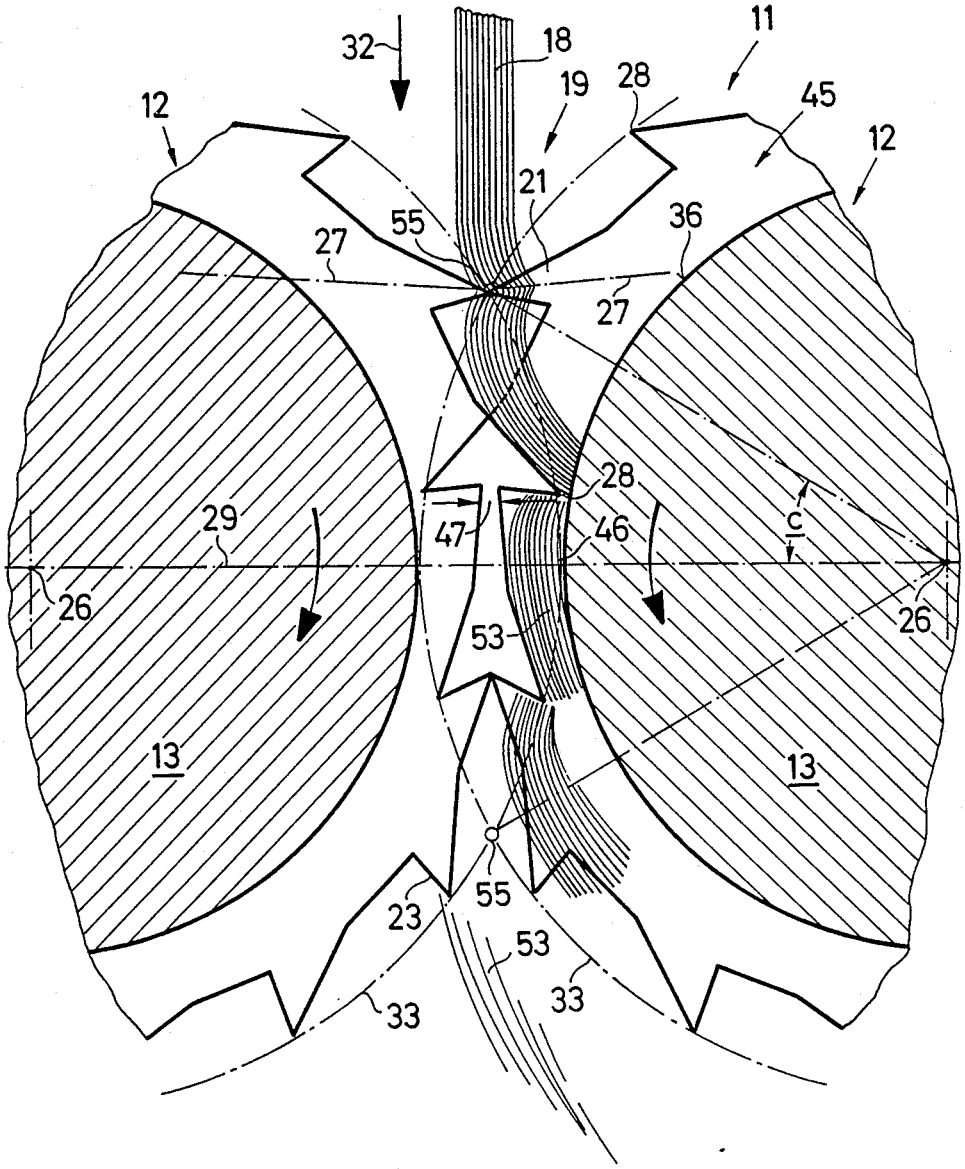

Angle a is to be determined in accordance with the meshing conditions. It is preferably as large as the effective pre-meshing angle b, by which the tooth tips 28 lead the common connecting plane 29 of the cutting roller axes 26 when the tooth tips 28 engage in material 18 of the prescribed maximum thickness 31 (e.g. 5 mm), this position being shown in FIG. 1. In this case, during said engagement the two planes 27 are substantially aligned with one another, or in the case of an admissible slight displacement of the two teeth in the circumferential direction are substantially parallel to one another. The teeth are then symmetrical to said plane and optimum engagement and transfer conditions are obtained. As a result of the further rotation, there is an increasing barb-like engagement, as shown in FIG. 2, where the teeth have reached the position where the tooth tips 28 in the represented side view are superimposed, but are in reality juxtaposed in the longitudinal direction. At least in this position, in which the teeth 21 are in front of the median plane 29 by the minimum pre-meshing angle c, advantageously the condition is fulfilled that the teeth have no inclination directed against the material passage direction 32 and either coincide with their planes 27, or are parallel or, as shown in FIG. 2, are inclined in the passage direction 32, in order to draw the material 18 into the cutting gap in an optimum manner.

FIG. 2 shows that in the position shown therein the said tooth tips 28 of the two cutting rollers are precisely at the front intersection 55 of the tooth tip circumferential circles 33, which between them define the start of the lenticular overlap sector. Angle c corresponds to half the angle formed by the connecting lines of said overlap sector with the cutting roller axes. Tilt angle a can be 20° to 45° and is preferably between 35° and 40°. Between their front and back surfaces 23, 24, the teeth form an included angle d of 30° to 60° and preferably 40° to 50°. Such a tooth is sufficiently pointed to adequately cut through the material to be comminuted, but is still sufficiently stable to withstand stronger loading and does not become prematurely worn.

Under the preferred conditions, this gives a tooth shape in which the front surfaces 23 of the teeth 21 pointing in the rotation direction are undercut by an angle between 5° and 25° and preferably approximately 15°, i.e. are forwardly inclined in the rotation direction.

The triangular teeth 21 forwardly inclined in the rotation direction are uniformly circumferentially distributed, namely with a pitch angle between 15° and 30°, preferably 20° and 24°, which corresponds to between 12 and 24 teeth (preferably 15 to 18 teeth). The tooth height 34 should be significantly smaller than the circumferential spacing of the tooth tips 28 and can be between 3 and 8%, preferably 5% of the cutting disk diameter. Related to the entire slot depth 35, i.e. the distance from tooth tip 28 or the circle 33 described by it to the slot bottom 36, the minimum overlap 47 of adjacent cutting disks on the tooth gullet or root 38 is approximately 10 to 30%, preferably 15 to 20%. This can be e.g. less than 4% and in particular less than 3% of the total cutting disk diameter. In the case of a realized, advantageous cutting tool for a cutting disk diameter of approximately 80 mm, the tooth height 34 can be approximately 4 mm, the circumferential spacing of the tooth tips approximately 15 mm and the total slot depth 35 10 mm. As advantageously both cutting disks engage in one another to such an extent that the tooth tips 28 run with a distance also forming a cutting gap of only a few tenths of a millimeter, preferably less than 0.5 mm, with respect to the slot bottom 36 of the facing roller, this gives an overlap in the region of the tooth roots 28, which due to the "tooth on tooth" synchronization for different cutting disks always coincide, of a few millimeters and in this case 2 mm.

The described tooth shape with a tooth or included angle d is in the case of the provided tooth height and pitch somewhat more acute than would lead to its rear surface 24 extending to the front surface of the next tooth. The rear surface 24 passes with a very obtuse angle into the tooth root 38, which runs substantially circumferentially. In the case of other overlap conditions and tooth shapes, the back surface could also extend to the next front surface.

It is also pointed out that the individual cutting disks or their teeth are somewhat reciprocally displaced in the longitudinal direction of the cutting rollers, so that a large pitch helix 49 if formed on the surface. The reciprocal displacement between adjacent cutting disks on the same cutting roller is therefore a few millimeters or fractions thereof. This helical displacement ensures that the engagement in an entering material is gentle and takes place continuously, while leading to no hard impacts. The displacement is oppositely directed on cooperating cutting rollers so that, apart from certain divergences of less than a millimeter, the "tooth on tooth" synchronization is retained.

As the cutting mechanism is suitable for cutting very narrow strips, the cutting disks are relatively thin, e.g. approximately 2 mm wide. FIG. 4 is a considerably enlarged view of a tooth, considered at right angles to the cutting shaft axis 26. It can be seen that in the vicinity of tooth tip 28, the tooth has a depression 40 in the form of a central, V-shaped notch, which ends a few tenths of a millimeter before the lateral faces 41 of the tooth and forms there on the tooth tip in each case a cutting edge 43 running in the direction of the cutting shaft axis 26, while the remaining edge 44 passes inwards in V-shaped manner.

The represented and described cutting mechanism functions according to the following procedure. The cutting mechanism 11 is intended for comminuting material 18, which is in the form of relatively thick layers and in the represented embodiment is up to approximately 5 mm thick (=50 sheets). This is comminuted into individual particles of approximate width 2 mm and length 15 mm. Thus, the ratio of the layer thickness to the particle width can be 2 or 3 and, based on the particle length, one third. This performance cannot be achieved with conventional shredding machines.

The material 18 for comminution, is e.g. fed through a corresponding slot in the apparatus casting (not shown) into the cutting gap 19 and it is there contacted by the cutting mechanism teeth 21. FIG. 1 shows the start of the engagement position of the teeth in their pre-meshing or pre-engaging position, which is forwardly displaced by angle b with respect to the median plane 29 of the cutting tool. In the preferred embodiment, the teeth have there a position in which their median planes 27 almost coincide. The penetration of the tooth tips 28 into the material taking place during the further rotation of the cutting rollers in rotation direction 22, consequently takes place without any component directed against the feed direction 32 and therefore under favorable loading conditions for the relatively slender, sharp tooth. The tooth tip 28 notched by depression 40 and which is consequently twice serrated, in the case of an adequate strength and stability of the tip, also leads to favorable penetration conditions and simultaneously tensions the paper somewhat in the transverse direction, so that it is not only laterally displaced, but is in fact separated and simultaneously the optimum feed or conveying effect is obtained.

It is clear that then (cf. FIG. 2) tooth 21 increasingly penetrates the layer, while being simultaneously forced somewhat into the slot 45 between the cutting disks 14. In the case of the adjacent slot, this takes place in the opposite direction, so that the forces acting against one another in each case form the force acting counter to the cutting force of the penetrating tooth. Simultaneously a longitudinal cut commences between the scissor-like-cooperating cutting edges 30, which are formed by the edges of tooth root 38 and the rear surface 24 and as can be gathered from the sequence of FIGS. 1 and 2, said cut progresses counter to the material running direction 32. The longitudinal cut also produces an opposing force, which aids the complete penetration of tooth 21 for making the cross-cut. The sectional view of FIG. 5 correspondingly has in each case a juxtaposed row of impressions which (due to the sloping or helical arrangement of the teeth) becomes progressively deeper and alternating upwardly and downwardly directed impressions and cross-cuts or separations 50. These are located close to the start of the longitudinal cut line 51 which, with increasing tooth meshing, is particularly extended against the feed or material running direction 32 until, relatively closely before the transverse separation point 50, it reaches the longitudinal cut line 51 of the cutting row behind it and consequently a particle 53 or, in the case of a material layer, a bundle of superimposed particles is cut free.

The longitudinal cut is in FIG. 1 just ended in the case of the centrally located particle bundle 53 and in this area normally also the cross-cut point 50 has also already passed through the bundle. If, in the case of particularly thick layers, there are still not yet completely transversely cut through points, they will be separated at the latest in the cutting gap 46 formed between the particular tooth tip 28 and the slot bottom 36.

The bundle of particles 53 is then further transported in slot 45, being moved forward somewhat in the slot by the front surface 23 of the following tooth, because the tooth is on a somewhat larger diameter and therefore has a higher circumferential speed than the adjacent slot bottom and the associated side wall parts. This again contributes to a clear separation of the particle bundle 53 from the following bundle. The forwardly inclined front surface 53 also ensures that the particle bundle is largely ejected from the slot, in that it acts in the manner of a shovel. Unlike in the case of conventional shredding machines, in which particle bundles adhere in the slot and must be removed therefrom exclusively by separate strippers, the slot in the case of the present invention keeps itself largely free and any strippers (not shown are consequently relieved. As a result the power requirement of the mechanism is reduced. This is in particular made possible by the "forwardly falling" tooth shape. The drawings also show that the slender tooth shape and the back of each tooth comprising back surface 24 and tooth root 38 make it possible to provide an adequate space in which the particle bundles 53 can be conveyed around. If necessary, the tooth surface contour could be made more hollow, should this be required for greater layer thicknesses.

It can also be seen that the effective overlap area, in which the lateral faces 41 of cutting disks 14, including the teeth 21, for adjacent cutting disks effectively run side by side and in which consequently friction can occur, is very small compared with the total lenticular theoretical overlap surface defined by the outer circles 33 (lune between points 55). This effective overlap surface, which roughly has the shape of an arrow directed counter to the material running direction, is as a result of the slender tooth shape and the limited overlap 47 on the tooth root very small and is effectively limited to a central strip as a result of its elongated shape and the tapering tooth tips, in which the circumferential speeds of the adjacent cutting disks 14 are the same, so that friction can only occur to a limited extent. It has in particular been shown that despite the very slender and apparently fragile tooth shape with a marked forward sweepback, the teeth 21 at the point of maximum penetration are precisely centrally loaded and act there in the manner of a true knife edge.

In the sectional view of FIG. 5, it is noteworthy that the juxtaposed cross-cut points 50 are in each case roughly in a row, but are upwardly and downwardly displaced at right angles to the plane of the material being comminuted. It can also be seen that on ejecting particle bundle 53 from the slot through the shovel action of the front surface 23 of tooth 21, said bundle is somewhat loosened, so that the individual particles drop in unordered manner into the following particle containers and this increases the security against reproduction of the document.

The tooth spacing on the outer circumference of the cutting disks, which determines the length of the particles, should be 1.5 to 5 and preferably 3 to 4 times as large as the tooth height and it can in particular be more than 5 times as large as the cutting disk thickness. This gives an optimum relationship between the processable layer thickness, particle size and force expenditure. In place of flat material layers, particularly of paper, the device is also suitable for comminuting other materials, e.g. foils, films, plastic parts or the like.

We claim:

1. Cutting mechanism for devices for comminuting material, particularly flat material layers, such as documents, comprising:

two cooperating cutting rollers driven in rotary synchronized manner in opposite rotation directions, the rollers having alternating, overlapping cutting disks, each cutting disk of one of the cutting rollers engaging in a ring slot between adjacent cutting disks of the other of the cutting rollers, outer edges of each cutting disk forming two cutting edges and having on an outer circumference of the disk teeth defining tooth tips extending from tooth roots, the tooth tips being aligned and the disks being synchronized such that on adjacent cutting disks two corresponding teeth are approximately juxtaposed in a longitudinal direction of the cutting rollers in a tooth -on-tooth relationship, the teeth being inclined forwards in sawtooth manner pointing in the rotation direction of the corresponding cutting roller, the adjacent cutting disks of the two cooperation cutting rollers being positioned such that the teeth of the adjacent cutting disks overlap one another radially at said tooth roots.

2. Cutting mechanism according to claim 1, wherein the teeth are inclined to form a tilt angle with respect to a radial alignment, which is larger than a minimum pre-meshing angle, defined as half angle of an overlap sector, which is formed between outer intersections of circumferential circles, which the tooth tips describe with the axis of each cutting roller.

3. Cutting mechanism according to claim 2, wherein the tilt angle substantially corresponds to an effective pre-meshing angle, defined as a lead angle of the tooth tips over a connecting plane of cutting roller axes when the tooth tips engage in a material layer of prescribed thickness.

4. Cutting mechanism to claim 2, wherein the tilt angle (a) is 25° to 45°.

5. Cutting mechanism according to claim 1, wherein the teeth have an included angle of 30° to 60°.

6. Cutting mechanism according to claim 1, wherein the front surfaces of the teeth pointing in the respective rotation direction are undercut and forwardly inclined by an angle between 5° and 25°.

7. Cutting mechanism according to claim 1, wherein the teeth have a height which is significantly smaller than a circumferential spacing between the tooth tips.

8. Cutting mechanism according to claim 7, wherein the circumferential spacing is between 3 and 8% of a diameter of the cutting disk.

9. Cutting mechanism according to claim 1, wherein a minimum overlap of adjacent cutting disks on the tooth root is less than 4% of a diameter of the cutting disk.

10. Cutting mechanism according to claim 1, wherein a minimum overlap of adjacent cutting disks on the tooth root is 10 to 30%.

11. Cutting mechanism according to claim 10, wherein the minimum overlap of adjacent cutting disks on the tooth route is 15 to 20% of the slot depth.

12. Cutting mechanism according to claim 1, wherein circumferential spacing of the tooth tips is more than 5 times as large as a thickness of the cutting disk.

13. Cutting mechanism according to claim 1, wherein circumferential spacing of the tooth tips corresponds to a circumferential angle of 15 to 30%.

14. Cutting mechanism according to claim 1, wherein the teeth engage the ring slots to such an extent that the teeth form a cutting gap of less than 0.5 mm with a bottom of a slot defined by adjacent cutting disks on one of the cutting rollers.

15. Cutting mechanism according to claim 1, wherein a connection between each tooth tip and an inner end of a front surface of the following tooth is inclined towards a center of the particular cutting roller.

16. Cutting mechanism according to claim 15, wherein back surfaces of the teeth directed counter to the rotation direction form an angle of 40° to 80° with the cutting disk radius passing through associated tooth tip and pass at a shallow angle into the associated tooth root.

17. Cutting mechanism according to claim 1, wherein the tooth tips have a depression.

18. Cutting mechanism according to claim 17, wherein the depression is a substantially V-shaped central notch with a V-angle of 90° to 120°, the notch being spaced from lateral surfaces of the tooth.

19. Cutting mechanism according to claim 1, wherein circumferential spacing of the tooth tips is 1.5 to 5 times as large as a height of the teeth.

* * * * *